US010421281B2

(12) United States Patent
Yamagishi et al.

(10) Patent No.: US 10,421,281 B2
(45) Date of Patent: Sep. 24, 2019

(54) LIQUID EJECTING APPARATUS

(71) Applicant: SEIKO EPSON CORPORATION, Tokyo (JP)

(72) Inventors: Akira Yamagishi, Shiojiri (JP); Akihiro Toya, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/893,016

(22) Filed: Feb. 9, 2018

(65) Prior Publication Data

US 2018/0229506 A1 Aug. 16, 2018

(30) Foreign Application Priority Data

Feb. 14, 2017 (JP) ..... 2017-025052

(51) Int. Cl.
*B41J 2/16* (2006.01)
*B41J 2/165* (2006.01)
*B41J 2/045* (2006.01)

(52) U.S. Cl.
CPC ..... *B41J 2/16579* (2013.01); *B41J 2/0451* (2013.01); *B41J 2/04586* (2013.01)

(58) Field of Classification Search
CPC ... B41J 2/16579; B41J 2/0451; B41J 2/04586
See application file for complete search history.

(56) References Cited

U.S. PATENT DOCUMENTS

2016/0129692 A1 5/2016 Ono et al.

FOREIGN PATENT DOCUMENTS

| | | | |
|---|---|---|---|
| JP | 09-024618 A | | 1/1997 |
| JP | 2007-160825 A | | 6/2007 |
| JP | 2007160825 A | * | 6/2007 |
| JP | 2016-088016 A | | 5/2016 |

OTHER PUBLICATIONS ip.com search (Year: 2018).*
Matsuse, Toshiya et al., Machine Translation of "Ink Leakage Detection Mechanism of Printer". (JP 2007-160825 A), Jun. 28, 2007, Seiko Epson Corp, Paragraphs 0025, 0027, 0036-0047 (Year: 2007).*

* cited by examiner

*Primary Examiner* — Lisa Solomon
(74) *Attorney, Agent, or Firm* — Workman Nydegger

(57) ABSTRACT

A liquid ejecting apparatus includes a casing, a liquid ejecting head configured to eject a liquid in the casing, an absorber capable of absorbing a portion of the liquid that has leaked into the casing, and a detector capable of detecting the portion of the liquid absorbed by the absorber. The absorber includes a detection portion to be detected by the detector and a plurality of extension portions extending from the detection portion.

11 Claims, 4 Drawing Sheets

LIQUID EJECTING APPARATUS

BACKGROUND

1. Technical Field

The present invention relates to a liquid ejecting apparatus such as a printer.

2. Related Art

As an example of a liquid ejecting apparatus, there is a printer in which a sheet composed of an ink absorber is laid over the entire inner bottom surface of a casing and which detects leakage of ink inside the casing by detecting the ink absorbed by the ink absorber by using a detector (for example, JP-A-2007-160825).

When the ink absorber is laid over the entire inner bottom surface of the casing, it takes time for the ink to permeate into a position detectable by the detector. Consequently, the time it takes for the leaked ink to be detected is prolonged.

SUMMARY

An advantage of some aspects of the invention is that a liquid ejecting apparatus capable of quickly detecting a leaked liquid is provided.

A liquid ejecting apparatus according to an aspect of the invention includes a casing, a liquid ejecting head configured to eject a liquid in the casing, an absorber capable of absorbing a portion of the liquid that has leaked into the casing, and a detector capable of detecting the portion of the liquid absorbed by the absorber. The absorber includes a detection portion to be detected by the detector and a plurality of extension portions extending from the detection portion.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of the liquid ejecting apparatus will be described with reference to the accompanying drawings. The liquid ejecting apparatus is, for example, an ink jet printer that records (prints) on a medium such as paper by ejecting ink which is an example of a liquid.

Figure 1:
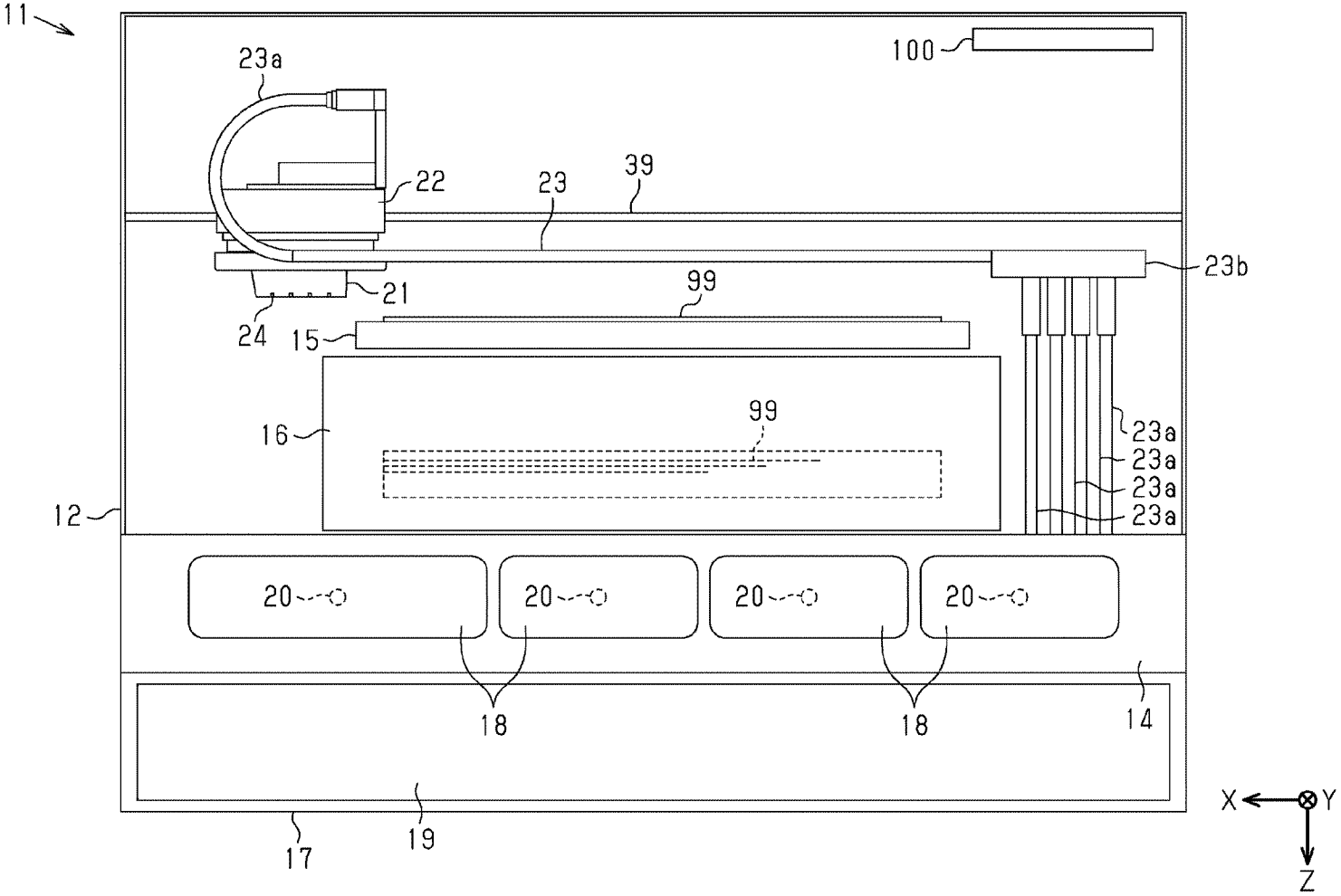
FIG. 1 is an overall schematic diagram of an embodiment of a liquid ejecting apparatus.

As illustrated in FIG. 1, a liquid ejecting apparatus 11 includes a casing 12, a mounting unit 14 on which liquid containers 18 are detachably mounted, a cassette 16 capable of housing a medium 99, a support table 15 capable of supporting the medium 99, and a control unit 100. The liquid containers 18 are containers capable of housing a liquid. The cassette 16 is detachably mounted in the casing 12. One or a plurality of additional units 17 can be disposed at positions aligned with the casing 12 in the direction of gravity Z. A cassette 19 capable of accommodating the medium 99 is mounted in the additional unit 17.

The mounting unit 14 has liquid introducing portions 20 capable of introducing the liquid contained in the liquid containers 18. One or a plurality of the liquid containers 18 are detachably mounted in the mounting unit 14.

The liquid containers 18 are mounted in the mounting unit 14 by being moved in the depth direction Y and are removed from the mounting unit 14 by being moved in the opposite direction to the depth direction Y. When a plurality of the liquid containers 18 are mounted in the mounting unit 14, it is preferable to mount the plurality of liquid containers 18 side by side in the width direction X.

The casing 12 is provided with a liquid ejecting head 21, a carriage 22 that holds the liquid ejecting head 21 and reciprocates in the width direction X, a guide shaft 39 that guides the movement of the carriage 22, and a supply flow path 23 arranged so as to supply the liquid to the liquid ejecting head 21. The liquid introducing portions 20 form the upstream end of the supply flow path 23.

The liquid ejecting head 21 has nozzles 24 capable of ejecting liquid and moves together with the carriage 22. The liquid ejecting head 21 is configured to eject liquid toward the medium 99 supported by the support table 15 during movement. The control unit 100 controls the components of the liquid ejecting apparatus 11, such as the liquid ejecting head 21.

Figure 2:
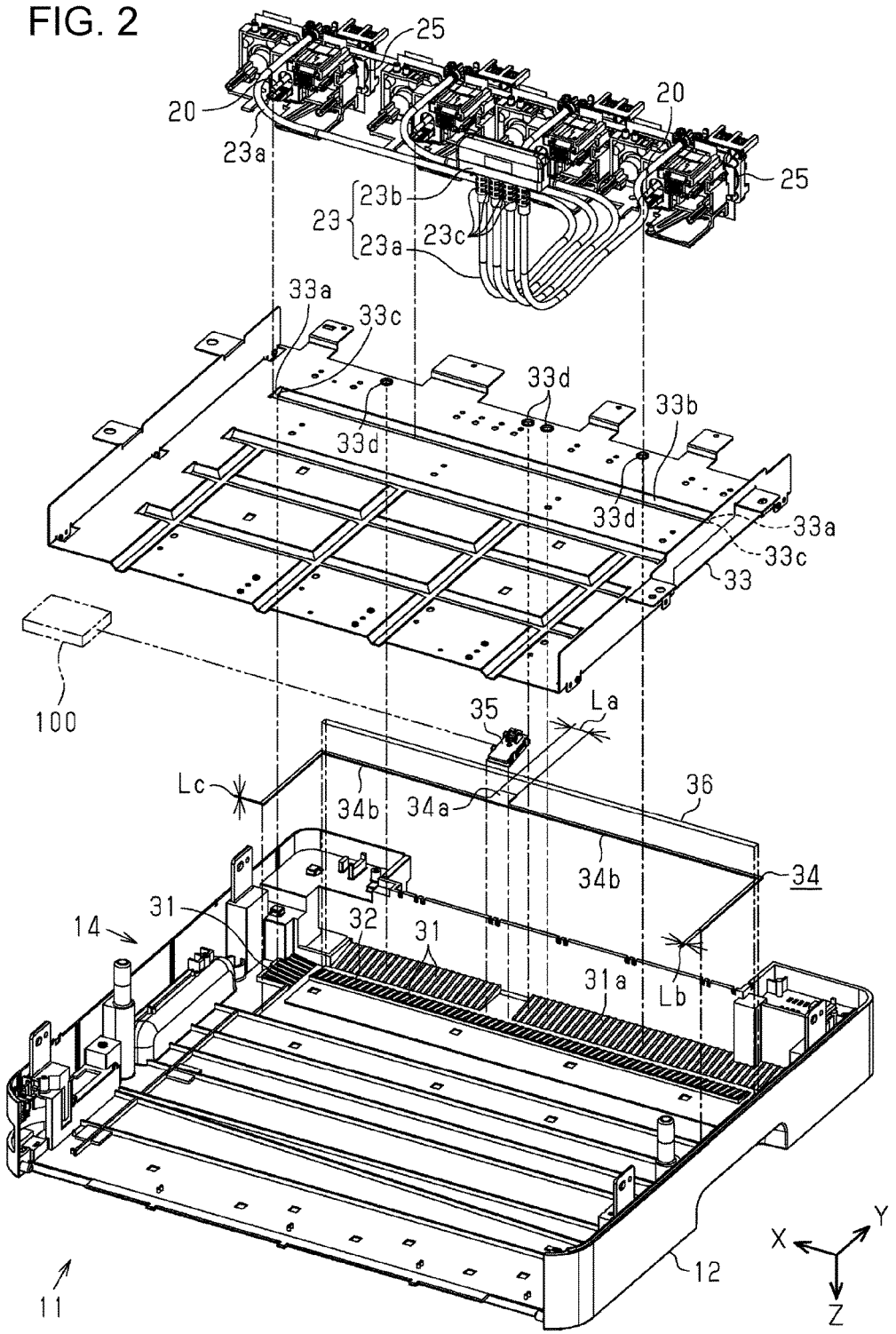
FIG. 2 is an exploded perspective view illustrating a configuration of a main portion of the liquid ejecting apparatus of FIG. 1.

As illustrated in FIG. 2, the supply flow path 23 is formed by connecting a plurality of flow path forming members 23*a* and 23*b* to each other. Consequently, there are one or more joints 23*c* in the supply flow path 23. For example, the flow path forming members 23*a* are flexible deflection tubes, and the flow path forming member 23*b* is a fitting or the like having a higher rigidity than the tubes. Such portions where the flow path forming members 23*a* and the flow path forming member 23*b* are connected to each other are the joints 23*c*. In addition, examples of the joints 23*c* include portions where the flow path forming members 23*a* and the flow path forming member 23*b* are connected to each other and portions where the flow path forming members 23*a* and 23*b* are connected to other members. As another member to which the flow path forming members 23*a* and 23*b* are connected, for example, there is a pump 25 for pressurizing and supplying liquid.

Liquid may leak from the liquid introducing portions 20 or the joints 23*c* in some cases. Consequently, an absorber 34 capable of absorbing the liquid that has leaked into the casing 12 and a detector 35 capable of detecting the liquid absorbed by the absorber 34 are arranged on the inner bottom portion of the casing 12. The absorber 34 has a detection portion 34*a* to be detected by the detector 35 and a plurality of extension portions 34*b* extending from the detection portion 34*a*.

The extension portions 34*b* are, for example, formed in a belt shape. In this case, the width dimension Lb of the extension portions 34*b* is preferably smaller than the width dimension La of the detection portion 34*a*. By reducing the width dimension Lb of the extension portions 34*b*, it is possible to shorten the time it takes for the liquid absorbed by the extension portions 34*b* to permeate into the detection portion 34*a*.

It is preferable that the thickness dimension Lc of the extension portions 34*b* be smaller than the width dimension Lb of the extension portions 34*b*. By reducing the thickness dimension Lc of the extension portions 34*b*, it is possible to shorten the time it takes for the liquid absorbed by the extension portions 34*b* to permeate into the detection portion 34*a*.

For example, the detector 35 may be provided so as to sandwich the detection portion 34*a* vertically or it may be provided so as to be in contact with one surface of the detection portion 34*a*. The detection portion 34*a* includes not only a portion that the detector 35 is in contact with, but also a portion from which the plurality of extension portions 34*b* branch out. The detector 35 may be configured to detect the liquid in a non-contact manner by using the detection portion 34*a*.

The detector 35 is electrically connected to the control unit 100. When the liquid absorbed by the extension portions 34*b* permeates into the detection portion 34*a*, the detector 35 detects the liquid. Upon detecting the liquid, the detector 35 transmits a detection signal to the control unit 100. As described above, the detector 35 detects the liquid that has leaked into the casing 12.

At the inner bottom portion of the casing 12, it is advisable to provide a housing unit 32 that houses the absorber 34. For example, the casing 12 has inclined portions 31 inclined downward toward the absorber 34 and the housing unit 32 formed along the inclined portions 31. In this case, the leaked liquid flows along the inclined portions 31 and is efficiently absorbed by the absorber 34. A plurality of ribs 31*a* arranged side by side in a direction in which the extension portions 34*b* extend may be provided in the inclined portions 31. The absorber 34 may be fixed to the casing 12 with an adhesive or a double-sided tape.

A cover 36 may be disposed so as to cover at least a portion of the absorber 34. The cover 36 can be formed of, for example, a synthetic resin film. If the evaporation of the liquid absorbed by the absorber 34 is suppressed by the cover 36, the leaked liquid can be satisfactorily detected. In addition, in an environment with high humidity, absorption of moisture by the absorber 34 is suppressed by the cover 36. Consequently, erroneous detection due to moisture absorption is unlikely to occur.

In the casing 12, it is preferable to dispose, below the supply flow path 23, a liquid receiving portion 33 capable of receiving the leaked liquid. It is preferable that the liquid receiving portion 33 be disposed above the absorber 34.

The liquid receiving portion 33 may be, for example, a sheet metal supported by the casing 12. By providing the sheet metal, the rigidity of the casing 12 is improved. The liquid receiving portion 33, which is a sheet metal, may have a plurality of holes 33*d*.

The liquid receiving portion 33 preferably has accumulation positions 33*a* for accumulating the received liquid and a passage 33*b* extending toward the accumulation positions 33*a*. The accumulation positions 33*a* may be disposed at the end of the passage 33*b* or may be disposed in the middle of the passage 33*b*.

At least a portion of the extension portions 34*b* or the inclined portions 31 may be arranged directly below the accumulation positions 33*a*. According to this configuration, the liquid received by the liquid receiving portion 33 can be efficiently collected in the accumulation positions 33*a* through the passage 33*b*, and the collected liquid can flow from the accumulation positions 33*a* to the extension portions 34*b*.

Through holes 33*c* may be formed at the accumulation positions 33*a* of the liquid receiving portion 33. According to this configuration, the liquid collected in the accumulation positions 33*a* can be dropped from the through holes 33*c* and absorbed by the extension portions 34*b* located below. In the case where the passage 33*b* is a groove, the ends of the groove may be set as the accumulation positions 33*a*, and the extension portions 34*b* may be disposed just under the passage 33*b*. In this case, the ends of the extension portions 34*b* may be positioned under the accumulation positions 33*a*, or the middle of the extension portions 34*b* may be positioned under the accumulation positions 33*a*.

In the case where the liquid receiving portion 33 has the holes 33*d*, the liquid leaking from the supply flow path 23 may leak downward from the holes 33*d*. Consequently, it is preferable to arrange at least a portion (end or middle portion) of the extension portions 34*b* below the joints 23*c* or the liquid introducing portions 20.

The accumulation positions 33*a*, the holes 33*d*, the joints 23*c*, or the lower side of the liquid introducing portions 20 can be liquid drop points. Consequently, the extension portions 34*b* or the inclined portions 31 may be arranged so that the extension portions 34*b* pass through a plurality of drop points. According to this configuration, a plurality of drop points can be covered by a single one of the extension portions 34*b*. As a result, the manufacturing cost of the extension portions 34*b* can be reduced, and the installation work of the extension portions 34*b* can be simplified.

Even if the extension portions 34*b* do not exist right under the liquid drop points, if the inclined portions 31 are disposed below the drop points, the dropped liquid can be guided to the extension portions 34*b*. In the case where the upper surface of the extension portions 34*b* is covered with the cover 36, the inclined portions 31 may be disposed along the side surface of the extension portions 34*b*. In this case, the absorber 34 can absorb the liquid, which has flowed along the inclined portions 31, from the side surface of the extension portions 34*b*.

Figure 3:
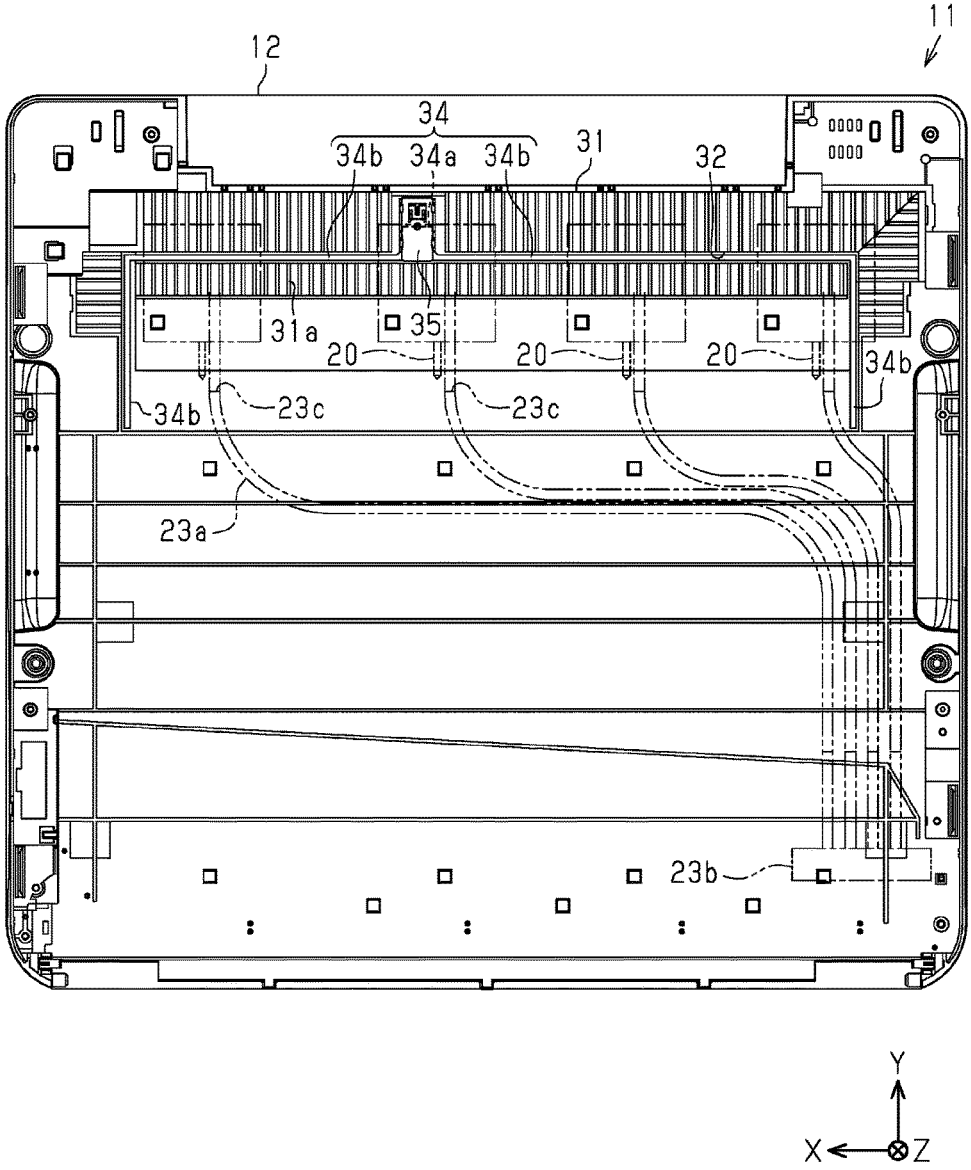
FIG. 3 is a plan view illustrating an arrangement of a detector and an absorber provided in the liquid ejecting apparatus of FIG. 1.

As illustrated in FIG. 3, the plurality of extension portions 34*b* extending from the detection portion 34*a* may have different lengths or arrangements from each other. In particular, when there is a place where there is a high probability of leakage of liquid or a place where there is a large amount of leakage, if the detection portion 34*a* is arranged near the place, it is possible to shorten the time it takes for the detector 35 to detect the liquid. For example, the detection portion 34*a* and the detector 35 may be disposed below the supply flow paths 23 having a large supply amount of liquid out of the plurality of supply flow paths 23.

Next, operations and effects of the liquid ejecting apparatus 11 configured as described above will be described.

(1) The plurality of extension portions 34*b* extending from the detection portion 34*a* can efficiently absorb the liquid that has leaked into the casing 12. The liquid absorbed by the extension portions 34*b* quickly permeates into the detection portion 34*a*. Consequently, even when the amount of leaked liquid is small, it is possible to quickly detect the leaked liquid.

(2) It is possible to absorb the leaked liquid by the extension portions 34*b* by disposing the extension portions 34*b* below locations where the liquid is likely to fall, such as the accumulation positions 33*a*, the holes 33*d*, the joints 23*c*, or the liquid introducing portions 20.

(3) The liquid absorbed by the extension portions 34*b* quickly permeates into the detection portion 34*a* as compared with the case where it is absorbed by a sheet-shaped absorbing material having a wide laying area. Therefore, even when a small amount of liquid leaks out, the detector 35 can quickly detect the liquid.

The above embodiment may be modified as in the following modification examples. The configurations included in the above embodiment and the configurations included in the following modification examples may be arbitrarily combined and the configurations included in the following modification examples may be arbitrarily combined.

Figure 4:
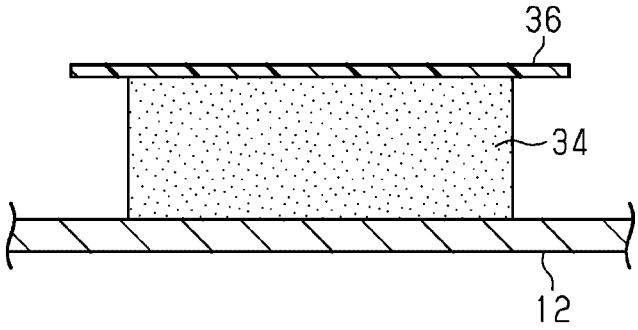
FIG. 4 is a first modification example of a cover covering the absorber of FIG. 3.

As in the first modification example illustrated in FIG. 4, the absorber 34 may be attached to the inner bottom surface of the casing 12.

As in the first modification example illustrated in FIG. 4, the cover 36 may be attached to at least a portion of the absorber 34.

Figure 5:
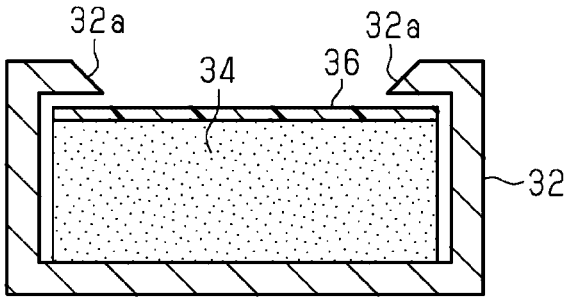
FIG. 5 is a second modification example of a cover covering the absorber of FIG. 3.
Figure 6:
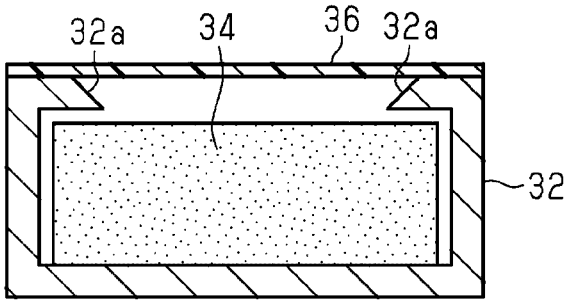
FIG. 6 is a third modification example of a cover covering the absorber of FIG. 3.

As in the second modification example illustrated in FIG. 5 or the third modification example illustrated in FIG. 6, the housing unit 32 surrounding at least a portion of the absorber 34 may be provided. In this case, as in the second modification example illustrated in FIG. 5, the cover 36 may be placed in the housing unit 32, or, as in the third modification example illustrated in FIG. 6, the cover 36 may be attached outside the housing unit 32.

As in the second modification example illustrated in FIG. 5 or the third modification example illustrated in FIG. 6, engaging claws 32*a* may be provided in the housing unit 32, and the movement of the absorber 34 may be suppressed by the engaging claws 32*a*.

A protrusion may be provided on the inner bottom portion of the casing 12, and the movement of the absorber 34 may be suppressed by this protrusion.

A groove may be formed in the inner bottom portion of the casing 12, and the absorber 34 may be accommodated in this groove. According to this configuration, the movement of the absorber 34 can be suppressed. In this case, if the cover 36 is disposed so as to cover the groove, the attachment of the cover 36 is easy.

A plurality of the detection portions 34*a* may be provided on a single one of the absorber 34 and a plurality of the detectors 35 may be disposed individually corresponding to the plurality of the detection portions 34*a*. According to this configuration, leakage of the liquid can be detected earlier.

The absorber 34 may be formed in a net shape, and the intersecting portions of the net may be used as the detection portions 34*a*.

The absorber 34 may be formed in a band shape. In this case, it is preferable that the middle portion of the band be the detection portion 34*a*, and the portions between the detection portion 34*a* and both ends of the absorber 34 be the extension portions 34*b*. In this configuration, the width dimension La of the detection portion 34*a* and the width dimension Lb of the extension portions 34*b* may be equal.

The absorber 34 may be formed in a cross shape and the intersecting portion may be set as the detection portion 34*a*.

The absorber 34 and the detector 35 may be disposed in the additional unit 17.

The cross-sectional shape of the extension portions 34*b* can be an arbitrary shape such as a rectangle or a circle. The extension portions 34*b* do not have to have the same cross-sectional shape over the entire length, and the width dimension Lb or the thickness dimension Lc may be changed halfway.

The extension portions 34*b* of the absorber 34 may be routed in the vertical direction. According to this configuration, the extension portions 34*b* can be disposed at arbitrary positions where the liquid easily leaks out.

The detection portion 34*a* and the extension portions 34*b* may be integrally formed of, for example, a porous body, or the detection portion 34*a* may be connected to the extension portions 34*b* composed of a thread, string, or the like which are bodies that are separate from the detection portion 34*a* composed of a non-woven fabric or the like.

The liquid ejected from the liquid ejecting head 21 is not limited to ink and, for example, may be a liquid material in which particles of a functional material are dispersed or mixed in a liquid or the like. For example, the liquid ejecting head 21 may eject a liquid material containing a material in a dispersed or dissolved form such as an electrode material or a coloring material (pixel material) used for manufacturing a liquid crystal display, an EL (electroluminescence) display, a surface emitting display, or the like.

The medium 99 is not limited to paper, but may be a plastic film, a thin board-like material, or a cloth used for a textile printing apparatus or the like. The medium 99 may be a clothing item having an arbitrary shape such as a T-shirt, or a three-dimensional object having an arbitrary shape such as an item of tableware or stationery.

Technical ideas grasped from the above-described embodiment and modifications and their operational effects will be described below.

Idea 1

A liquid ejecting apparatus includes a casing, a liquid ejecting head configured to eject a liquid in the casing, an absorber capable of absorbing a portion of the liquid that has leaked into the casing, and a detector capable of detecting the portion of the liquid absorbed by the absorber. The absorber includes a detection portion to be detected by the detector and a plurality of extension portions extending from the detection portion.

According to this configuration, the plurality of extension portions extending from the detection portion can efficiently absorb the liquid that has leaked into the casing. The liquid absorbed by the extension portions quickly permeates into the detection portion. Consequently, even when the amount of leaked liquid is small, it is possible to quickly detect the leaked liquid.

Idea 2

In the liquid ejecting apparatus according to Idea 1, the extension portions are formed in a band shape and a width dimension of each of the extension portions is smaller than a width dimension of the detection portion.

According to this configuration, by reducing the width dimension of the extension portions, it is possible to shorten the time it takes for the liquid absorbed by the extension portions to permeate into the detection portion.

Idea 3

In the liquid ejecting apparatus according to Idea 2, a thickness dimension of each of the extension portions is smaller than the width dimension of each of the extension portions.

According to this configuration, by reducing the thickness dimension of the extension portions, it is possible to shorten the time it takes for the liquid absorbed by the extension portions to permeate into the detection portion.

Idea 4

The liquid ejecting apparatus according to any one of Idea 1 to Idea 3 further includes a supply flow path arranged to supply the liquid to the liquid ejecting head and a liquid receiving portion capable of receiving the portion of the liquid that has leaked. The liquid receiving portion includes an accumulation position where the portion of the liquid that has been received is accumulated and a passage extending toward the accumulation position and is disposed below the supply flow path, and at least a portion of the extension portions is arranged directly under the accumulation position.

According to this configuration, the liquid received by the liquid receiving portion can be efficiently collected at the accumulation position through the passage, and the collected liquid can flow from the accumulation position to the extension portions.

Idea 5

In the liquid ejecting apparatus according to Idea 4, a through hole is formed at the accumulation position of the liquid receiving portion.

According to this configuration, the liquid collected in the accumulation position can drop from the through hole and be absorbed by the extension portions below.

Idea 6

In the liquid ejecting apparatus according to any one of Idea 1 to Idea 5, the casing includes an inclined portion inclined downward toward the absorber.

According to this configuration, the liquid leaked in the casing flows along the inclined portion and is efficiently absorbed by the absorber.

Idea 7

The liquid ejecting apparatus according to any one of Idea 1 to Idea 6 further includes a supply flow path arranged to supply the liquid to the liquid ejecting head. The supply flow path is formed by connecting a plurality of flow path forming members, and at least a portion of the extension portions is disposed below joints of the flow path forming members.

According to this configuration, the liquid leaked from the joints of the flow path forming members can be absorbed by the absorber located below the flow path forming members.

Idea 8

The liquid ejecting apparatus according to any one of Idea 1 to Idea 7 further includes a mounting unit on which a liquid container capable of containing the liquid is mountable. The mounting unit includes a liquid introducing portion capable of introducing the liquid, and at least a portion of the extension portions is disposed below the liquid introducing portion.

According to this configuration, the liquid leaked from the liquid introducing portion can be absorbed by the absorber located below the liquid introducing portion.

Idea 9

The liquid ejecting apparatus according to any one of Idea 1 to Idea 8 further includes a cover arranged to cover at least a portion of the absorber.

According to this configuration, evaporation of the liquid absorbed by the absorber is suppressed by the cover. Therefore, the portion of the liquid that has leaked can be detected satisfactorily. Absorption of moisture by the absorber under a high humidity environment is suppressed by the cover. Consequently, erroneous detection due to moisture absorption is unlikely to occur.

The entire disclosure of Japanese Patent Application No. 2017-025052, filed Feb. 14, 2017, is expressly incorporated by reference herein.

What is claimed is:

1. A liquid ejecting apparatus comprising:

a casing;

a liquid ejecting head configured to eject a liquid in the casing;

an absorber capable of absorbing a portion of the liquid that has leaked into the casing; and a detector capable of detecting the portion of the liquid absorbed by the absorber, wherein the absorber is disposed in a detection portion to be detected by the detector and is disposed in a plurality of extension portions branching and extending from the detection portion.

2. The liquid ejecting apparatus according to claim 1, wherein the extension portions are formed in a band shape, and a width dimension of each of the extension portions is smaller than a width dimension of the detection portion.

3. The liquid ejecting apparatus according to claim 2, wherein a thickness dimension of each of the extension portions is smaller than the width dimension of each of the extension portions.

4. The liquid ejecting apparatus according to claim 1, further comprising:

a supply flow path arranged to supply the liquid to the liquid ejecting head; and a liquid receiving portion capable of receiving the portion of the liquid that has leaked, wherein the liquid receiving portion includes an accumulation position where the portion of the liquid that has been received is accumulated and a passage extending toward the accumulation position and is disposed below the supply flow path, and wherein at least a portion of the extension portions is arranged directly under the accumulation position.

5. The liquid ejecting apparatus according to claim 4, wherein a through hole is formed at the accumulation position of the liquid receiving portion.

6. The liquid ejecting apparatus according to claim 1, wherein the casing includes an inclined portion inclined downward toward the absorber.

7. The liquid ejecting apparatus according to claim 1, further comprising a supply flow path arranged to supply the liquid to the liquid ejecting head, wherein the supply flow path is formed by connecting a plurality of flow path forming members, and wherein at least a portion of the extension portions is disposed below joints of the flow path forming members.

8. The liquid ejecting apparatus according to claim 1, further comprising a mounting unit on which a liquid container capable of containing the liquid is mountable, wherein the mounting unit includes a liquid introducing portion capable of introducing the liquid, and wherein at least a portion of the extension portions is disposed below the liquid introducing portion.

9. The liquid ejecting apparatus according to claim 1, further comprising a cover arranged to cover at least a portion of the absorber.

10. A liquid ejecting apparatus comprising:

a casing;

a liquid ejecting head configured to eject a liquid in the casing;

an absorber capable of absorbing a portion of the liquid that has leaked into the casing; and a detector capable of detecting the portion of the liquid absorbed by the absorber, wherein the absorber includes a detection portion to be detected by the detector and an extension portion extending from the detection portion, and wherein the casing includes an inclined portion inclined downward towards the absorber.

11. A liquid ejecting apparatus comprising:

a casing;

a liquid ejecting head configured to eject a liquid in the casing;

an absorber capable of absorbing a portion of the liquid that has leaked into the casing; and a detector capable of detecting the portion of the liquid absorbed by the absorber; and a supply flow path arranged to supply the liquid to the liquid ejecting head, wherein the absorber includes a detection portion to be detected by the detector and an extension portion extending from the detection portion, wherein the supply flow path is formed by connecting a plurality of flow path forming members, and wherein at least a portion of the extension portions is disposed below joints of the flow path forming members.

* * * * *